US005356361A

United States Patent [19]

Watenpaugh

[11] Patent Number: 5,356,361

[45] Date of Patent: Oct. 18, 1994

[54] SELF-GENERATING OSCILLATING PRESSURE EXERCISE DEVICE

[75] Inventor: Donald E. Watenpaugh, Sunnyvale, Calif.

[73] Assignee: The United States of America as represented by the Administrator of National Aeronautics and Space Administration, Washington, D.C.

[21] Appl. No.: 61,401

[22] Filed: May 13, 1993

[51] Int. Cl.[5] ..... A63B 21/008

[52] U.S. Cl. ..... 482/111; 601/23

[58] Field of Search ..... 482/111, 112; 128/24 R, 128/24.1, 402, 202.12; 601/23

[56] References Cited

U.S. PATENT DOCUMENTS 2,832,336 6/1955 Davis et al. ..... 128/24.1
3,836,141 9/1974 Franklyn .
3,884,463 5/1975 Malatesta .
4,635,931 1/1987 Brännstam .
4,666,148 5/1987 Crawford .
4,772,016 9/1988 Manion .
4,824,105 4/1989 Goldenberg .
4,830,366 5/1989 Ruden .
5,133,339 7/1992 Whalen et al. .

*Primary Examiner*—Richard J. Apley
*Assistant Examiner*—Lynne A. Reichard
*Attorney, Agent, or Firm*—Guy M. Miller; Darrell G. Brekke

[57] ABSTRACT

An exercise device, especially suitable for zero gravity workouts, has a collapsible chamber which generates negative pressure on the lower portion of a body situated therein. The negative pressure is generated by virtue of leg, hand and shoulder interaction which contracts and expands the chamber about the person and by virtue of air flow regulation by valve action.

11 Claims, 3 Drawing Sheets

SELF-GENERATING OSCILLATING PRESSURE EXERCISE DEVICE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 426; 42 U.S.C. 2457).

FIELD OF THE INVENTION

The present invention relates generally to the field of exercise equipment and, more specifically, to a self-generating oscillating pressure exercise device suitable for use in normal, low or zero gravity environments.

BACKGROUND OF THE INVENTION

Deconditioning of musculoskeletal and cardiovascular systems occurs when there is a lack of gravitational load on the body during space flight. If conditioning exercise is not undertaken in such situations, substantial health problems will eventually ensue upon return to normal Earth gravity. Exercising in zero gravity poses many problems as most conventional exercise equipment and the exercises themselves are either dependent upon gravity or are limited to conditioning one set of muscles. What is needed for zero gravity exercise is a simple, self powered device which is not dependent upon gravity and which provides simultaneous, integrated musculoskeletal and cardiovascular stimulation. To effectively simulate exercise in Earth gravity, the device should impose pressure gradients across walls of blood vessels in the working muscle, especially in the lower body. Furthermore, externally-imposed pressure oscillations can facilitate blood flow to working muscle.

U.S. Pat. No. 5,133,339 to Whalen, et al. discloses an exercise method and apparatus utilizing differential air pressure. The apparatus includes a pressure chamber and an exercise device located therein. The chamber is not itself the exercise device and it requires an external power source to generate differential air pressure.

U.S. Pat. No. 3,836,141 relates to a chest exercising device in which a bellows mechanism is used to provide a resistance force against motion by the intake and expulsion of air. A valve is provided to control the resistance level. The device, disclosed in the '141 patent, is strictly external and does not effect pressure applied to the user's body.

U.S. Pat. No. 4,635,931 relates to a bellows like pneumatic exercise apparatus having attachments to secure the device to a bed post and a user with applications directed to leg and arm exercises.

U.S. Pat. No. 3,884,463 relates to a bellows type pneumatic exercise device which may be used for biceps, chest, back and leg exercises. The apparatus is held by the user.

U.S. Pat. No. 4,666,148 relates to an exercise device which is worn by the user to exercise face muscles. A mask having an inflatable liner is attached to the user's face. Once attached, the liner is inflated to provide resistance to facial motion. The unit is not sealed and the static pressure of the air bag liner is not negative pressure.

U.S. Pat. No. 4,772,016 relates to a pneumatic cylinder to provide resistance between two arms of a hinged exercise apparatus. A pressure restricter is manually adjustable to effect the resistance force.

U.S. Pat. No. 4,824,105 relates to an abdominal exerciser which is worn by the user having an air pressure chamber to provide bi-directional resistance to motion.

U.S. Pat. No. 4,830,366 relates to a compressible air bag used for exercising with various attachments to be secured to the body. Illustrated in this reference are examples of applications directed to arm and leg exercises.

None of these devices impose self-generated external pressure changes on the working muscle tissue. There is a need in the art for an integrated exercise device which provides both exercise for the user's muscles and external pressure oscillations on the user's body which can facilitate blood flow to the exercising muscles.

SUMMARY OF THE INVENTION

An object of the present invention is to provide an exercise device which is effective in normal, low or zero gravity conditions.

Another object of the present invention is to provide an exercise device capable of providing external pressure oscillations on the user's body which can facilitate blood flow to the exercising muscles.

Still another object of the invention is to provide an exercise device which is light weight, collapsible and thus easy to store, and simple in construction and operation.

These and other objects are met by providing an exercise device which includes first and second substantially rigid end walls, a flexible, variable length sidewall extending between and hermetically connected to the first and second end walls to define an air chamber having a variable volume, the air chamber being adapted to enclose at least a portion of a user's body and having an internal air pressure which varies in accordance with variations in volume, the sidewall being expandable and contractible in length to thereby vary the internal pressure in response to a force applied to one of the first and second end walls by the user, the applied force generating a reaction force delivered to the other of the first and second end walls, and the applied force being resisted by a pneumatic force generated by a difference between the internal air pressure of the air chamber and ambient air pressure outside the air chamber.

Other objects, advantages and salient features of the invention will become apparent from the following detailed description, which taken in conjunction with the annexed drawings, discloses preferred embodiments of the invention.

DETAILED DESCRIPTION OF THE INVENTION

Figure 1:
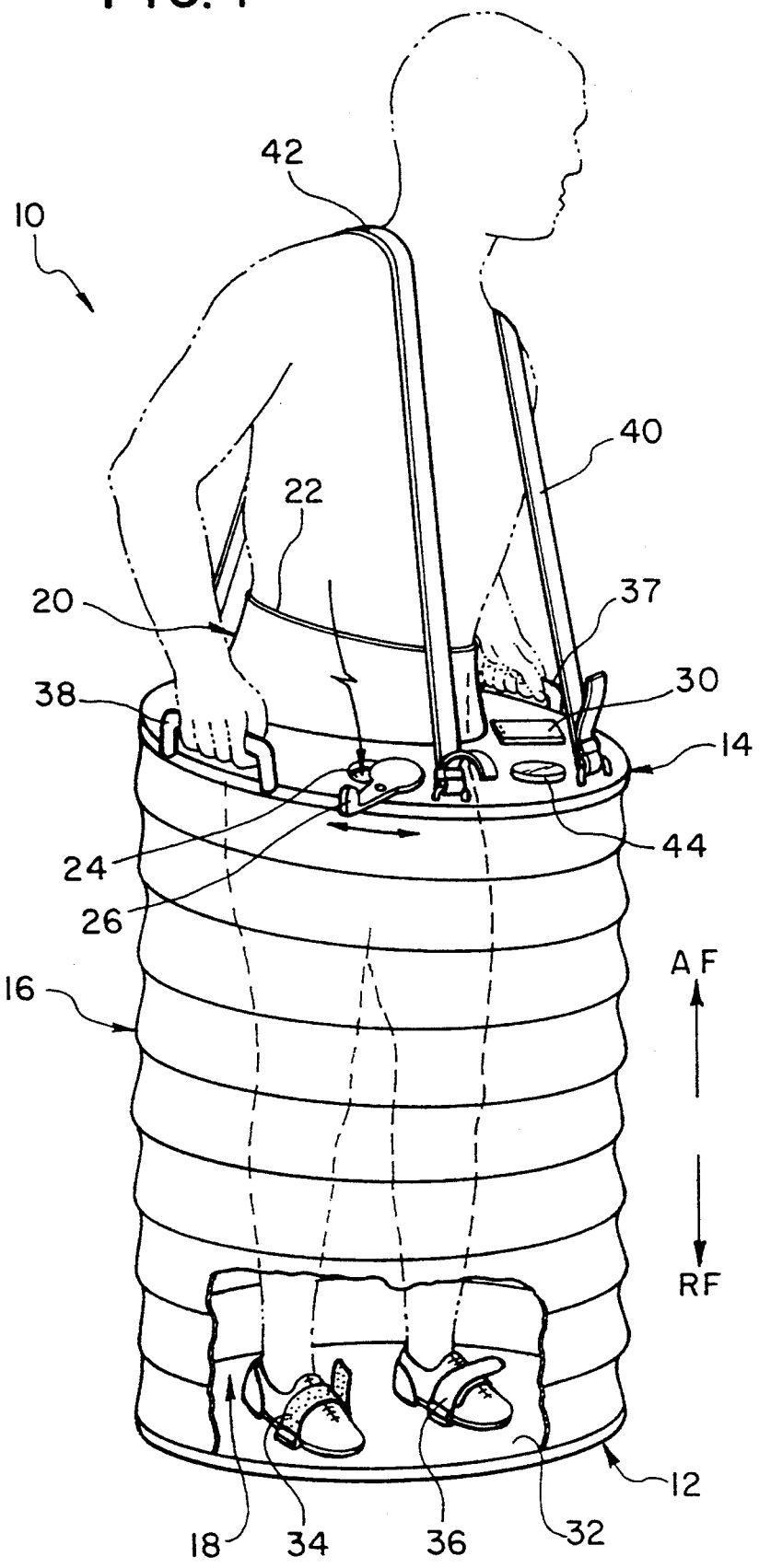
FIG. 1 is a perspective view, partially cut-away, of an exercise device according to the present invention in a substantially expanded condition, with the user in a standing position.
Figure 2:
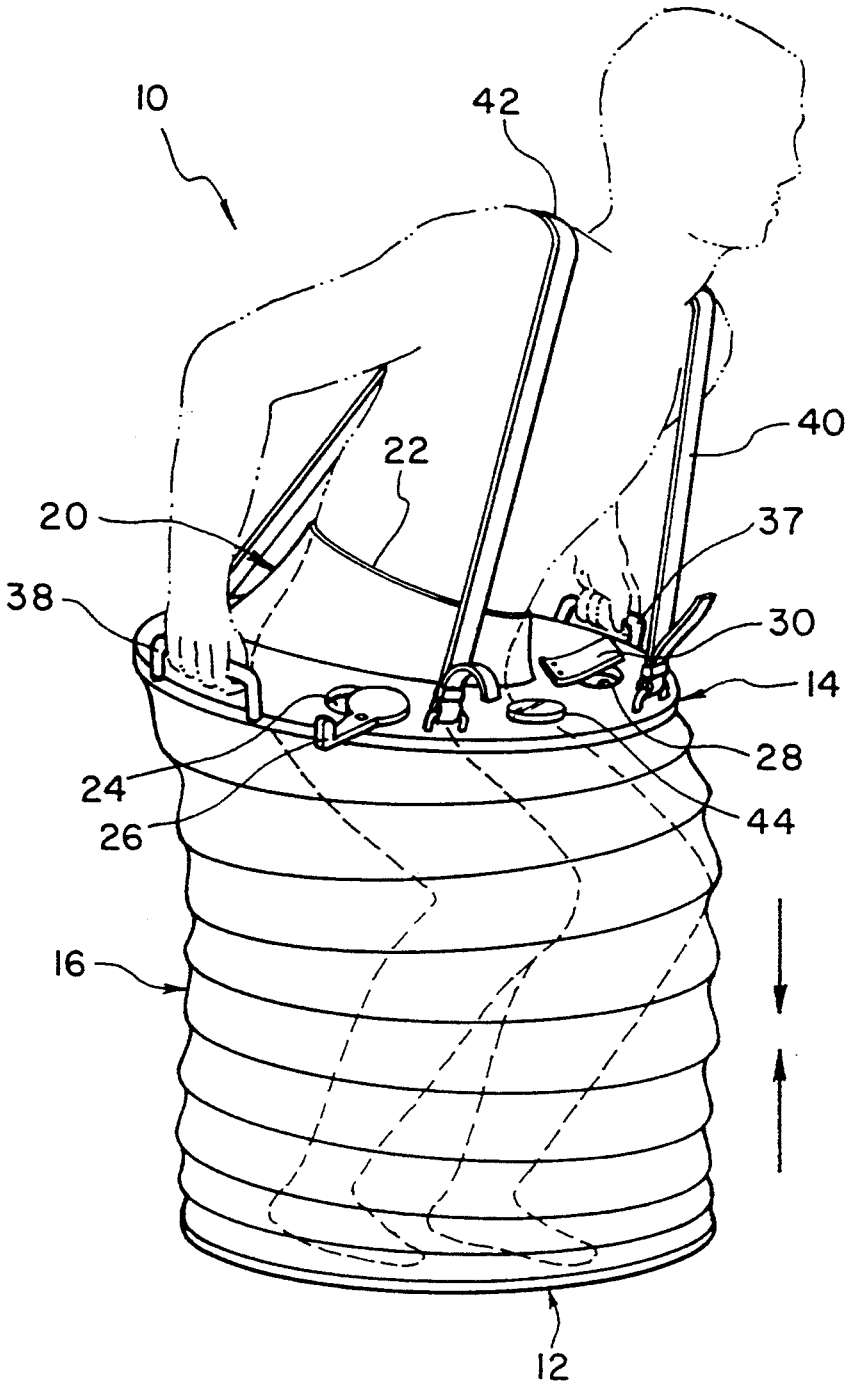
FIG. 2 is a perspective view of the exercise device of FIG. 1 in a contracted condition, with the user in a knees-bent position.

Referring to FIGS. 1–4, an exercise device 10 includes a first substantially rigid end wall 12, a second substantially rigid end wall 14, and a flexible, variable length sidewall 16 disposed between and hermetically connected to the first and second end walls 12 and 14. Preferably, the end walls are circular in shape and together with the sidewall 16 define a cylindrical air chamber 18 which encloses at least a portion of the user's body.

The sidewall 16, which is expandable and contractible in length, is made of a rubberized canvas or other suitable airtight flexible fabric connected to a coiled wire support. In the preferred embodiment, the legs of the user are enclosed and the air chamber contracts when force is applied to the second end wall 14 as when the user performs knee bends. The user is illustrated in a knee-bent position in FIG. 2, and in an upright position in FIG. 1.

The second end wall 14 has a large center opening which is fitted with an elastic collar 20. An upper circumferential edge 22 of the collar frictionally engages the torso of the user to seal the user's legs within the air chamber 18. The collar 20 is made of the type of material used in kayakskirts.

An opening 24 is formed in the second end wall 14 to provide fluid communication between the air chamber 18 and the ambient outside the air chamber 18. A valve 26 pivotally connected to the upper surface of the end wall 14 provides means for adjusting the size of the opening 24 from fully open to fully closed. An additional opening 28 (FIG. 4) is provided with a check valve 30 which flaps open when the sidewall 16 is contracted to provide additional air expulsion from the air chamber 18. The valves and openings for regulating air flow are preferably located on the end wall 14 but could also be located, less conveniently, on the end wall 12.

An inner surface 32 of the end wall 12 is provided with a pair of foot straps 34 and 36 for holding the feet of the user. A pair of handles 37 and 38 are connected to the end wall 14 on diametrically opposite sides thereof to provide hand-holds for the user. A pair of adjustable shoulder straps 40 and 42 are likewise connected to the upper surface of the end wall 14. The user applies a force "AF" to the device 10 which causes expansion in the length of of the sidewall 16. A reaction force "RF" generated and delivered to the end wall 12 through the legs of the user. Of course, the forces can be reversed, and the amount of the applied force necessary to cause axial expansion is determined by the amount of a pneumatic force which resists expansion. This force is a function of the size of the opening 24, which is regulated by the user's selected position of the valve 26. The foot straps, shoulder straps, and handles facilitate application of the applied and reaction forces to the device 10.

In use, the user places his or her legs into the air chamber and adopts a leg extended position as shown in FIG. 1. This can be a vertical upright position, as illustrated, or a horizontal position if the device is suspended. In a weightless environment, any orientation can be employed. As the user moves into the knee-bent position illustrated in FIG. 2, air is expelled from the air chamber through both openings 24 and 28 and no or slight pneumatic resistance is experienced to the applied force. When the user extends the legs and thus expands the length of the air chamber 18 to thereby expand its volume, a reduced internal air pressure is generated, as compared to the surrounding ambient, and this reduced air pressure resists the axial expansion of the sidewall 16. The amount of pneumatic resistance is determined by the position of the valve 26.

Figure 3:
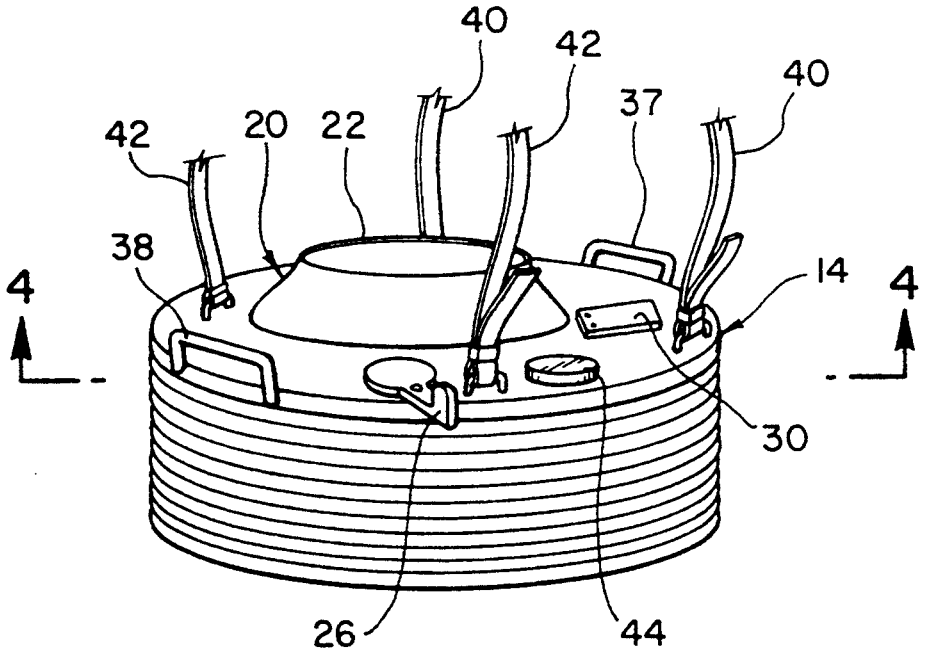
FIG. 3 is a perspective view of the exercise device of FIG. 1 in the collapsed condition suitable for storage.

FIG. 3 shows the fully collapsed form of the device when not in use. It is apparent from FIG. 3 that the device can be stored easily and in a relatively small amount of space. No radial expansion of the device occurs when contracted into the storage mode. In this position the fabric has been folded inwardly and the coiled supporting wire is stacked.

Figure 4:
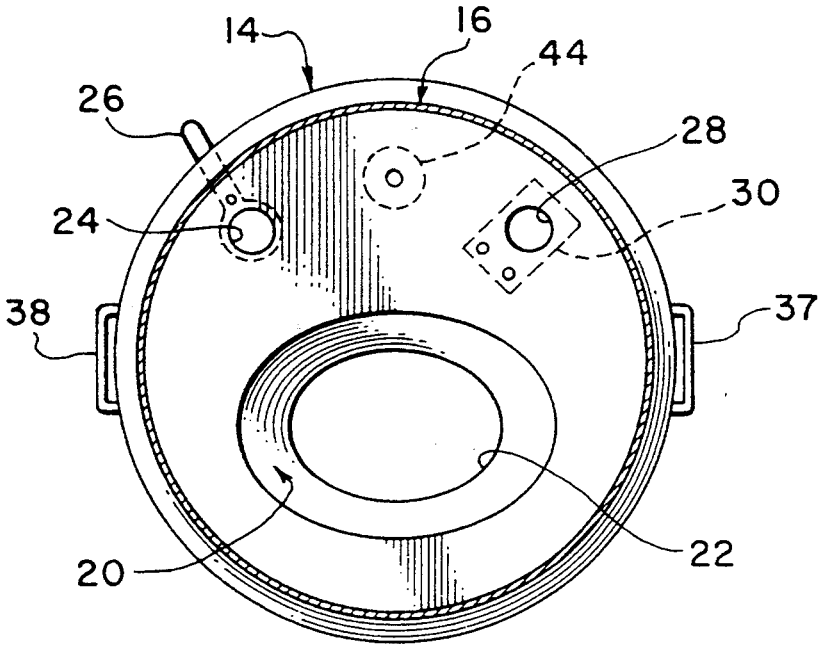
FIG. 4 is a cross-sectional view of the exercise device of FIG. 1, taken along line 4—4 of FIG. 3.

FIG. 4 is a cross-sectional view of the device 10 taken along line 4—4 of FIG. 3, and shows the inside of the top most portion of the cylindrical air chamber. The circumferential area between the outer circumferential edge of the collar 20 and the circumferential edge of the central opening provides an adjustment and sealing zone for engaging the user's torso and creating a seal therewith. The collar can be attached hermetically to the end wall 14 around the central opening using any suitable means. The material from which the collar is constructed may extend into and overlie the outer surface of the end wall 14 to enhance the hermetic seal formed between the collar 22 and the end wall 14.

The operability of the device 10 is straightforward. Exercise against the footward force produced by lower body negative pressure (LBNP) provides a simple and inexpensive technique to simulate gravity during spaceflight. To allow the legs themselves to generate the negative pressure against which they work, the flexible cylinder around the lower body is sealed at the waist and expands and collapses longitudinally, but not radially. As the legs push forward against the inner surface 32 to expand the cylinder, the air pressure in the cylinder decreases which in turn increases the force required to continue expanding the cylinder. The negative pressure is limited by adjustable valve 26 to allow controlled air flow into the cylinder through the opening 24. The check valve 30 remains shut during cylinder expansion, but allows air to enter the cylinder during retraction, thus simulating knee bends. It is possible to omit the check valve 30 and opening 28 thus providing two-way pneumatic resistance. Shoulder straps and handles on top of the cylinder allow the user to counteract the downward force exerted by their legs. Force produced depends on air inflow rate, cylinder radius, and length and rate of expansion.

Optionally, a vacuum gauge 44 can be provided on the end wall 14 to provide visual feed back to the user as to the amount of work that is being performed. Any conventional gauge can be employed.

Example

Seven healthy subjects (5 males, 2 females; age 23–48; height 160–183 cm; and weight 43.6–90.9 kg) performed five to six minutes of simple knee bend exercise in a device 10. Footward force (Dual Force Monitor, Electronic Quantification Inc., Plymouth Meeting, Pa.), cylinder pressure (Millar pressure transducer, Millar Instruments, Houston, Tex.), and heart rate (ECG) were continuously recorded on an eight channel strip chart recorder (Astromed 9500, Astromed Inc., Warwick, R.I.) or a computer data acquisition system (Labtech Notebook software, Laboratory Technologies, Wilmington, Mass.; DAS 20 board, Metrabyte, Taunton, Mass.). Oxygen consumption was measured prior to and during the final minute of exercise with turbine volumetry and gas analysis. Exercise rate was guided by a metronome set at 20 cylinder retraction/expansion cycles per minute, and the air inlet valve was adjusted so footward force during cylinder expansion peaked at approximately 150% of body weight. Heart rate was quantified during oxygen consumption measurements.

In two subjects, a maximum footward force was obtained with the adjustable inlet valve 24 completely closed, and was expressed as a percent of maximum leg press (determined using a Nautilus device). In addition, one subject exercised at maximum effort for one minute with the adjustable inlet valve 24 closed, 25% open, 50% open, and 100% open: to demonstrate the effects of air inflow resistance on exercise rate and force development.

Supine exercise against self-generated LBNP was comfortable and well-tolerated. Subjects tended to exceed the target peak force of 1.5 body weights: peak force averaged 1116±87N (163±5% body weight; Table 1). After 5 min of cyclic exercise to this level (@19±1 cylinder retractions and expansions per minute), mean oxygen consumption increased 6-fold from 4.7±0.3 ml $O_2 \times kg^{-1} \times min^{-1}$ at rest to 30.9±1.4 ml $O_2 \times kg^{-1} \times min^{-1}$, and heart rate increased from 68±3 beats $\times min^{-1}$ to 143±6 beats$\times min^{-1}$. All subjects could have exercised longer and at greater intensity.

Table 1 illustrates how maximal exercise rate and force development vary with air inlet resistance in one subject. With increasing air inlet resistance, both higher negative pressure and peak force were generated, while maximum rate of exercise was decreased. This subject exceeded his maximal leg press (Nautilus) effort by 24% when using the self-generating negative pressure exerciser. Another subject (the strongest in our group) achieved 2958N (302 kg) at maximal effort in the negative pressure exerciser.

TABLE 1

Relationship between Air Inlet Valve Status and Self-Generated LBNP Exercise Characteristics

| Valve Status | Air Inlet Resistance | Cylinder Expansion/ Retraction rate (cycles/mm) | Max LBNP Generated (mmHg) | Max Force Generated (N) | Max Force Generated (kg) | % of Max (Nautilus) Leg Press |
|---|---|---|---|---|---|---|
| 100% open | LOW | 43 | 23 | 943 | 96 | 47 |
| 50% open | ↓ | 35 | 35 | 1343 | 137 | 67 |
| 25% open | ↓ | 25 | 50 | 1855 | 190 | 93 |
| closed | HIGH | 3 | 63 | 2473 | 253 | 124 |

These findings demonstrate that self-generated lower body negative pressure exercise provides both aerobic and anaerobic (resistance) training in supine subjects. Exercise was performed while supine because recumbency simulates the musculoskeletal and cardiovascular unloading found in microgravity. Therefore, these results document the potential for the invention to provide both aerobic and resistance exercise in microgravity.

The exercise device 10 possesses many features which make it attractive for use during space flight. First, it is safe: workload is controlled and limited entirely by the user, no potentially dangerous inertial forces are generated, and the maximum attainable LBNP levels (about 70 mmHg) are transient and user-dependent. Second, the device 10 exercises primarily the large anti-gravity muscle groups in the legs and back in a manner similar to a standing leg press. These muscles are very susceptible to microgravity-induced atrophy, and therefore in need of exercise during space flight. Also, spinal loading from this type of exercise may prove beneficial to alleviate back pain experienced by astronauts. Third, exercise with this device hypothetically elicits intermittent increases in lower body vascular transmural pressures, and may effectively simulate the circulatory conditions of upright exercise on Earth by redistributing blood and body fluids from upper to lower body. Fourth, the self-generating LBNP exerciser provides a wide range of exercise rate and workload by simply adjusting the air inlet resistance. Fifth, the body is ventilated by the cycling of air in and out of the cylinder. (Lack of convection in microgravity hypothetically reduces air flow over the skin during exercise.) Sixth, the device requires no external power source: the user's movements generate the negative pressure against which they work, and force feedback could be provided by a simple aneroid pressure gauge.

Other advantages include: ease of use, low vibration during free-floating use (to minimize impact on sensitive materials science experiments), simplicity, low mass, collapsibility for stowage, and economy of construction. Other devices for the trunk and upper body could also employ self-generated pneumatic pressure differentials to exercise against. One major disadvantage of the existing prototype is the lack of eccentric exercise capability. Design modifications are possible, however, to permit this type of exercise. Eccentric skeletal muscle activation may be important for maintenance of anti-gravity muscle strength, because existence in gravity commonly imposes eccentric exercise on such muscles. Nevertheless, the concept of exercising against self-generated pneumatic pressure differentials offers a novel and versatile new means of exercising in microgravity.

An exercise method of the present invention entails cyclically changing the internal pressure of the air chamber by performing reciprocating exercise routines, such as, but not limited to, knee-bends. The cycle durations and frequencies are user-determined. Certain parameters may be chosen to maximize either or both the exercise effect and the circulatory effect.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. An exercise device comprising:

first and second substantially rigid end walls; and a flexible, variable length sidewall extending between and hermetically connected to the first and second end walls to define an air chamber having a variable volume, the air chamber being adapted to enclose at least a portion of a user's body and having an internal air pressure which varies in accordance to variations in volume, the sidewall being expandable and contractible in length to thereby vary the internal pressure in response to a force applied to one of the first and second end walls by the user, the applied force generating a reaction force delivered to the other of the first and second end walls, and the applied force being resisted by a pneumatic force generated by a difference between the internal air pressure of the air chamber and ambient air pressure outside the air chamber.

2. An exercise device according to claim 1, further comprising means for regulating air flow into the cylinder during expansion to thereby adjust the pneumatic force.

3. An exercise device according to claim 2, wherein the regulating means comprises a first opening formed in the first end wall and a first valve member pivotally connected to the end wall to permit movement of the valve member over the opening.

4. An exercise device according to claim 1, further comprising check valve means for exhausting air from the air chamber during one of expansion and contraction of the sidewall.

5. An exercise device according to claim 1, further comprising first retaining means for holding the portion of the user's body contained in the air chamber to one of the first and second end walls, and second retaining means for holding a portion of the user's body disposed outside the air chamber to the other of the first and second end walls.

6. An exercise device according to claim 1, wherein the first retaining means comprises foot straps disposed on an inner surface of the second end wall.

7. An exercise device according to claim 6, wherein the second retaining means comprises adjustable shoulder straps connected to an outer surface of the first end wall.

8. An exercise device according to claim 7, wherein the second retaining means further comprises a pair of handles disposed on the first end wall.

9. An exercise device according to claim 1, further comprising access means, disposed in the first end wall, for sealingly permitting ingress and egress of the portion of the user into the air chamber.

10. An exercise device according to claim 9, wherein the access means comprises a central opening forming in the first end wall with an elastic collar disposed around the central opening for sealingly engaging a portion of a user's body.

11. An exercise device according to claim 1, wherein the sidewall is made of a rubberized fabric connected to a coiled wire support.

* * * * *